US010214936B2

(12) United States Patent
Reddy et al.

(10) Patent No.: US 10,214,936 B2
(45) Date of Patent: Feb. 26, 2019

(54) SIDE SADDLE SLINGSHOT DRILLING RIG

(71) Applicant: Nabors Drilling Technologies USA, Inc., Houston, TX (US)

(72) Inventors: Padira Reddy, Richmond, TX (US); Ashish Gupta, Jr., Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 15/615,322

(22) Filed: Jun. 6, 2017

(65) Prior Publication Data

US 2017/0350153 A1 Dec. 7, 2017

Related U.S. Application Data

(60) Provisional application No. 62/346,982, filed on Jun. 7, 2016.

(51) Int. Cl.
*E04H 12/34* (2006.01)
*E21B 15/00* (2006.01)
(Continued)

(52) U.S. Cl.
CPC ..... *E04H 12/345* (2013.01); *B66F 3/24* (2013.01); *B66F 3/28* (2013.01); *B66F 7/0633* (2013.01); *B66F 7/08* (2013.01); *E21B 15/003* (2013.01)

(58) Field of Classification Search
CPC . E04H 12/345; B66F 3/28; B66F 3/24; E21B 15/003
(Continued)

(56) References Cited

U.S. PATENT DOCUMENTS 1,733,484 A 10/1929 Davis
2,332,479 A 10/1943 Woolslayer et al.
(Continued)

FOREIGN PATENT DOCUMENTS

CA 2755483 A1 11/2010
CA 2753417 A1 2/2011
(Continued)

OTHER PUBLICATIONS

International Search Report and Written Opinion issued in International Application No. PCT/US2017/036156, dated Sep. 1, 2017 (12 pages).

(Continued)

*Primary Examiner* — Joshua K Ihezie
(74) *Attorney, Agent, or Firm* — Adolph Locklar

(57) ABSTRACT

A side saddle slingshot drilling rig includes a left and right substructure including a left and right lower box. The side saddle slingshot drilling rig includes a drill rig floor mechanically and pivotably coupled to the left and right lower boxes such that it is pivotably movable from a lowered position to a raised position. The drill rig floor includes a V-door. The V-door is positioned on the V-door side of the drill rig floor. The V-door side of the drill rig floor is oriented to face the right substructure. A mast coupled to the drill rig floor may include an open side, defining a mast V-door side. The mast V-door side may be oriented to face the right substructure. The mast may pivot into its raised position or may be a bootstrap mast.

22 Claims, 13 Drawing Sheets

(51) Int. Cl.

| | |
|---|---|
| ***B66F 3/24*** | (2006.01) |
| ***B66F 3/28*** | (2006.01) |
| ***B66F 7/06*** | (2006.01) |
| ***B66F 7/08*** | (2006.01) |

(58) Field of Classification Search
USPC ..... 52/111, 114, 117, 118, 632, 651.05, 116
See application file for complete search history.

(56) References Cited

U.S. PATENT DOCUMENTS 2,345,253 A 3/1944 Funk
2,347,115 A 4/1944 Lewis
2,594,847 A 4/1952 Bates et al.
3,028,881 A 4/1962 Koomey et al.
3,255,836 A 6/1966 Hoppmann et al.
3,433,268 A 3/1969 Greer
3,483,933 A 12/1969 Dyer et al.
3,676,984 A 7/1972 Clark
3,716,149 A 2/1973 Scaggs
3,739,853 A 6/1973 Wales
3,802,137 A 4/1974 Armstrong
3,851,770 A 12/1974 Jenkins et al.
3,922,825 A 12/1975 Eddy et al.
3,942,593 A 3/1976 Reeve, Jr. et al.
3,997,435 A 12/1976 Farnum et al.
4,021,978 A 5/1977 Busse et al.
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,403,898 A 9/1983 Thompson
4,407,629 A 10/1983 Willis
4,421,179 A 12/1983 Boyadjieff
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,757,592 A 7/1988 Reed
4,759,414 A * 7/1988 Willis ..... E21B 15/00 173/185
4,823,870 A 4/1989 Sorokan
4,834,604 A 5/1989 Brittain et al.
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A 2/1996 Suksumake
6,161,358 A 12/2000 Mochizuki et al.
6,491,477 B2 12/2002 Bennett, Jr. et al.
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,255,180 B2 8/2007 Beato et al.
7,306,055 B2 * 12/2007 Barnes ..... E21B 7/02 175/122
7,308,953 B2 * 12/2007 Barnes ..... E21B 7/02 175/122
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 6/2011 Wright et al.
7,992,646 B2 8/2011 Wright et al.
8,051,930 B1 11/2011 Barnes et al.
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,516,751 B2 8/2013 Konduc et al.
8,549,815 B2 10/2013 Donnally et al.
8,555,564 B2 10/2013 Wasterval
8,573,334 B2 11/2013 Smith et al.
8,661,743 B2 3/2014 Flusche
8,720,128 B2 5/2014 Vogt
8,813,436 B2 8/2014 Donnally et al.
8,863,449 B2 10/2014 Donnally et al.
8,904,716 B2 * 12/2014 Donnally ..... E21B 15/00 52/117
8,985,238 B2 3/2015 Sorokan et al.
8,985,928 B2 3/2015 Flusche
9,027,287 B2 5/2015 Trevithick et al.
9,091,125 B2 7/2015 Konduc et al.
9,091,126 B2 * 7/2015 Thiessen ..... E21B 15/00
9,132,871 B2 9/2015 Crisp et al.
9,140,080 B2 9/2015 Flusche
9,151,412 B2 10/2015 Trevithick et al.
9,163,462 B2 10/2015 Donnally et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 * 7/2016 Mark ..... E21B 19/155
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,562,407 B2 2/2017 Magnuson
9,631,443 B2 4/2017 Folk
9,677,298 B2 6/2017 Konduc et al.
9,708,861 B2 * 7/2017 Reddy ..... E21B 15/003
9,790,751 B2 10/2017 Reddy et al.
9,810,027 B2 11/2017 Reddy et al.
9,845,813 B2 12/2017 Shimizu et al.
9,879,442 B2 1/2018 Magnuson et al.
9,926,719 B2 3/2018 Reddy et al.
2003/0172599 A1 * 9/2003 Frink ..... E21B 15/003 52/116
2004/0211598 A1 10/2004 Palidis
2005/0126827 A1 6/2005 Berry
2008/0237170 A1 10/2008 Altman et al.
2009/0000218 A1 1/2009 Lee et al.
2009/0025980 A1 1/2009 Callander et al.
2009/0200856 A1 8/2009 Chehade et al.
2010/0186960 A1 7/2010 Reitsma et al.
2011/0072737 A1 3/2011 Wasterval
2012/0304553 A1 12/2012 Konduc et al.
2013/0305632 A1 11/2013 Rivera, Sr. et al.
2014/0224543 A1 * 8/2014 Padira ..... E21B 15/003 175/85
2014/0298735 A1 * 10/2014 Vogt ..... E21B 7/023 52/118
2015/0008039 A1 * 1/2015 Wijning ..... E21B 7/02 175/52
2015/0143759 A1 * 5/2015 Sparkman ..... E21B 15/00 52/123.1
2015/0218891 A1 8/2015 Padira et al.
2015/0284950 A1 * 10/2015 Stramandinoli ..... E04B 2/965 52/235
2016/0298394 A1 10/2016 Reddy et al.
2016/0312543 A1 * 10/2016 Cheng ..... E21B 15/00
2016/0369570 A1 12/2016 Reddy et al.
2017/0106925 A1 4/2017 Gupta et al.
2017/0292334 A1 10/2017 Reddy et al.

(56) References Cited

U.S. PATENT DOCUMENTS

| | | | |
|---|---|---|---|
| 2018/0016851 | A1 | 1/2018 | Reddy et al. |
| 2018/0030788 | A1 | 2/2018 | Reddy et al. |
| 2018/0119496 | A1 | 5/2018 | Reddy et al. |
| 2018/0128056 | A1 | 5/2018 | Gupta et al. |

FOREIGN PATENT DOCUMENTS

| | | | |
|---|---|---|---|
| CN | 201778661 | U | 3/2011 |
| DE | 849533 | C | 9/1952 |
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Gaddy, Dean E., "Critical path analysis improves rig-moving procedures", Oil & Gas Journal, Nov. 16, 1998 (5 pages).

Nabors 990 Proyecto Llanos.wmv; https://www.youtube.com/watch?v=6BgfgWumRIU, Nabors Rig 990 Chichimene, Colombia; Youtube.com; Aug. 10, 2011 (231 pages).

Drilling Contractor; "Nabors modular Rig 702 in Papua New Guinea-bound for ExxonMobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

* cited by examiner

SIDE SADDLE SLINGSHOT DRILLING RIG

CROSS REFERENCE TO RELATED APPLICATIONS

This application is a U.S. non-provisional application which claims priority from U.S. provisional application No. 62/346,982, filed Jun. 7, 2016, which is incorporated by reference herein in its entirety.

TECHNICAL FIELD/FIELD OF THE DISCLOSURE

The present disclosure relates generally to drilling rigs, and specifically to slingshot rig structures for land drilling in the petroleum exploration and production industry.

BACKGROUND OF THE DISCLOSURE

Land-based drilling rigs may be configured to be traveled from location to location to drill multiple wells within the same area known as a wellsite. In certain situations, it is necessary to travel across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations.

SUMMARY

The present disclosure provides for a drilling rig. The drilling rig may include a right substructure and a left substructure. The substructures may be positioned generally parallel and spaced apart from each other. The drilling rig may also include a drill rig floor. The drill rig floor may include a V-door. The side of the drill rig floor including the V-door may define the V-door side of the drill rig floor. The V-door may be oriented to face perpendicular to the right substructure. The drilling rig may include a mast. The mast may include an open side which may define a mast V-door side. The open side may be oriented to face perpendicular to the right substructure. The mast may be pivotably coupled to the drill rig floor by one or more pivot points and one or more lower mast attachment points, the mast being pivotable in a direction parallel to the V-door side of the drill rig floor or the mast being pivotable in a direction perpendicular to the V-door side of the drill rig floor.

The present disclosure also provides for a method. The method may include providing a drilling rig. The drilling rig may include a right substructure and a left substructure. The right substructure may include a right lower box and a first strut, the first strut pivotably coupled to the drill rig floor and pivotably coupled to the right lower box. The left substructure may include a left lower box and a second strut, the second strut pivotably coupled to the drill rig floor and pivotably coupled to the left lower box. The substructures may be positioned generally parallel and spaced apart from each other. The drilling rig may include a drill rig floor. The drill rig floor may include a V-door. The side of the drill rig floor including the V-door may define the V-door side of the drill rig floor. The V-door may be oriented to face perpendicular to the right substructure. The method may include providing a mast. The mast may include an open side which may define a mast V-door side. The open side may be oriented to face perpendicular to the right substructure. The method may include mechanically coupling the mast to the drill rig floor and raising the mast into a raised position.

The present disclosure further provides for a hydraulic cylinder skid. The hydraulic cylinder skid includes a skid frame, the skid frame having a rig attachment point. The hydraulic cylinder skid also includes one or more raising cylinders, the raising cylinders pivotably coupled to the skid frame. In addition, the hydraulic cylinder skid includes a hydraulic power unit, the hydraulic power unit mechanically coupled to the skid frame and operatively coupled to the one or more raising cylinders.

The present disclosure provides for a method. The method includes providing a drilling rig. The drilling rig includes a right substructure and a left substructure, the substructures positioned generally parallel and spaced apart from each other. The right substructure includes a right lower box and a first strut, the first strut pivotably coupled to the drill rig floor and pivotably coupled to the right lower box. The left substructure includes a left lower box and a second strut, the second strut pivotably coupled to the drill rig floor and pivotably coupled to the left lower box. The drilling rig also includes a drill rig floor, the drill rig floor including a V-door. The side of the drill rig floor includes the V-door defining the V-door side of the drill rig floor. The V-door is oriented to face perpendicular to the right substructure. The method also includes providing a mast, the mast including an open side defining a mast V-door side. The open side is oriented to face perpendicular to the right substructure. The method also includes mechanically coupling the mast to the drill rig floor and positioning a hydraulic cylinder skid. The hydraulic cylinder skid includes a skid frame, the skid frame having a rig attachment point. The skid also includes one or more raising cylinders, the one or more raising cylinders pivotably coupled to the skid frame. The skid includes a hydraulic power unit, the hydraulic power unit mechanically coupled to the skid frame and operatively coupled to the one or more raising cylinders. The method includes mechanically coupling the skid frame to the drilling rig at the rig attachment point and raising the mast into a raised position using the raising cylinders.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
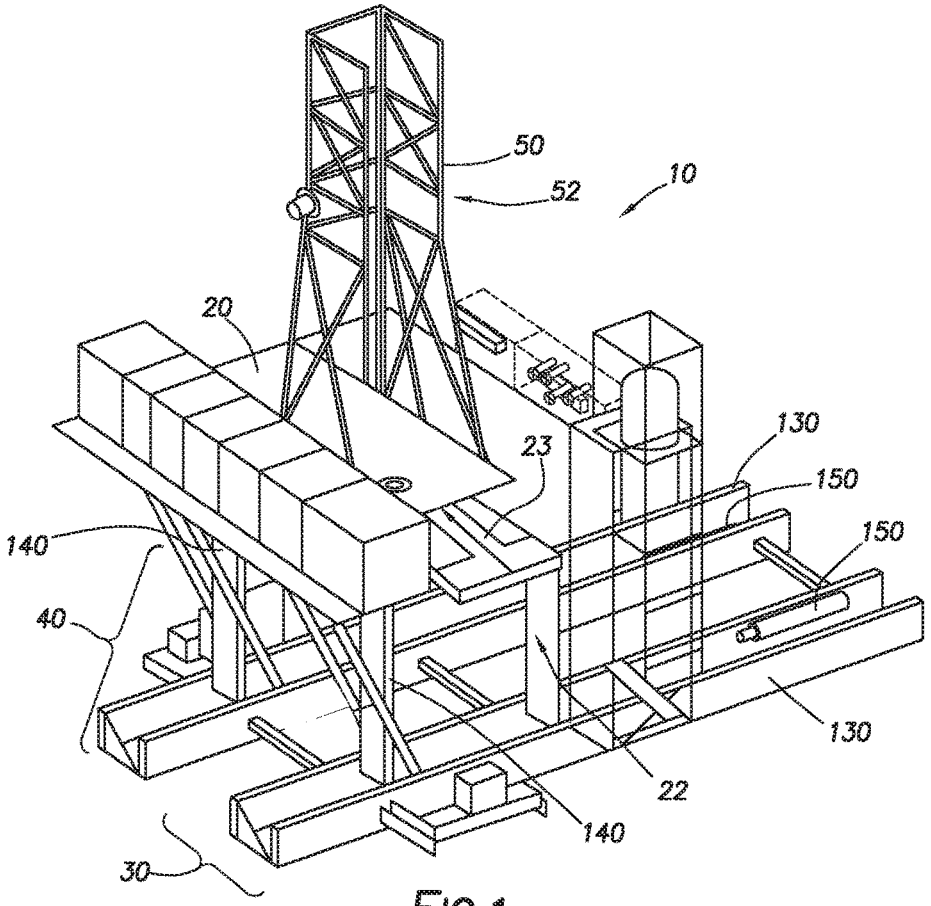
FIG. 1 depicts a perspective view of a side saddle slingshot rig consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a perspective view of side saddle slingshot drilling rig 10 in a mast raised position. In some embodiments, side saddle slingshot drilling rig 10 may include drill rig floor 20, right substructure 30, left substructure 40, and mast 50. Right and left substructures 30, 40 may support drill rig floor 20. Right and left substructures 30, 40 may be generally parallel and spaced apart in the right-left direction. As would be understood by one having ordinary skill in the art with the benefit of this disclosure, the terms "right" and "left" as used herein are only used to refer to each separate substructure to simplify discussion, and are not intended to limit this disclosure in any way. Right and left substructures 30, 40, may each include one or more lower boxes 130 and one or more struts 140. Drill rig floor 20 may be mechanically coupled to lower boxes 130 by struts 140. Struts 140 may be pivotably coupled to drill rig floor 20 and to one or more lower boxes 130. Lower boxes 130 may be generally parallel to each other and spaced apart in the left-right direction. In some embodiments, struts 140 may be coupled to drill rig floor 20 and lower boxes 130 such that struts 140 form a bar linkage between lower boxes 130 and drill rig floor 20, allowing relative motion of drill rig floor 20 relative to lower boxes 130 while maintaining drill rig floor 20 parallel to lower boxes 130 as further discussed herein below. In some embodiments, right substructure 30 may include a lower box 130 referred to herein as a right lower box. In some embodiments, left substructure 40 may include a lower box 130 referred to herein as a left lower box.

In some embodiments, drill rig floor 20 may include V-door 23. The side of drill rig floor 20 at which V-door 23 is referred to herein as V-door side 22. In some embodiments, V-door side 22 of side saddle slingshot drilling rig 10 may face the right substructure 30. In some embodiments, V-door 23 may be oriented to face perpendicular to right substructure 30. In some embodiments, V-door side 22 may be parallel to right substructure 30.

In some embodiments, mast 50 may include mast V-door side 52, defined as the open side of mast 50. In some embodiments, mast V-door side 52 may be aligned with V-door 23. In some embodiments, mast V-door side 52 may be oriented to face perpendicular to right substructure 30. In some embodiments, mast 50 may be pivotably coupled to drill rig floor 20 by one or more pivot points 60 and one or more lower mast attachment points 62. Lower mast attachment points 62 may be disconnected, allowing mast 50 to pivot on pivot points 60 as further discussed herein below. In some such embodiments, mast 50 may thus be lowerable from the upright position depicted in FIG. 1 to a lowered position.

Figure 2:
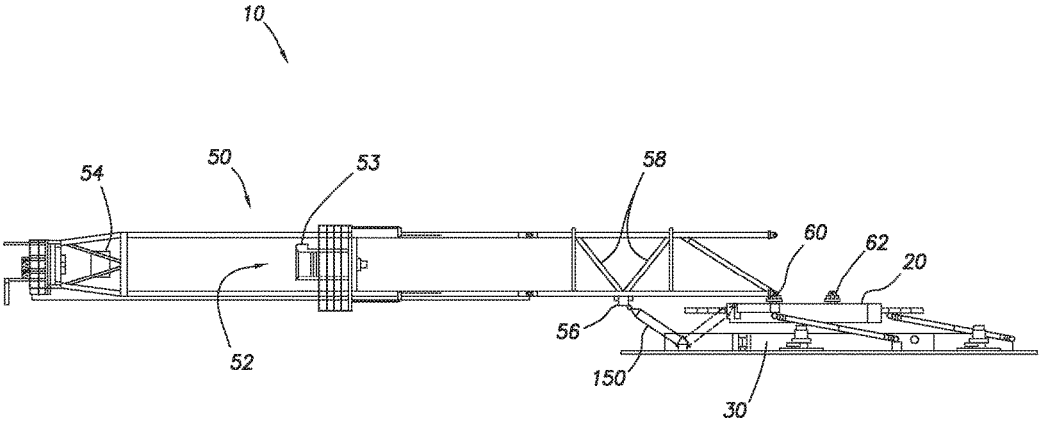
FIG. 2 depicts a side view of a side saddle slingshot rig in a lowered position consistent with at least one embodiment of the present disclosure.

FIG. 2 depicts side saddle slingshot drilling rig 10 consistent with at least one embodiment of the present disclosure. In some embodiments, mast 50 is pivotably lowerable in a direction parallel to V-door side 22 of drill rig floor 20. In such an embodiment, mast V-door side 52 may be oriented to face horizontally when mast 50 is in the lowered position. In such an embodiment, components of mast 50 including, for example and without limitation, top drive 53 and traveling block 54 may be retained within mast 50 without additional components. In some embodiments, mast 50 may be removable from drill rig floor 20 and transported horizontally.

Figure 3:
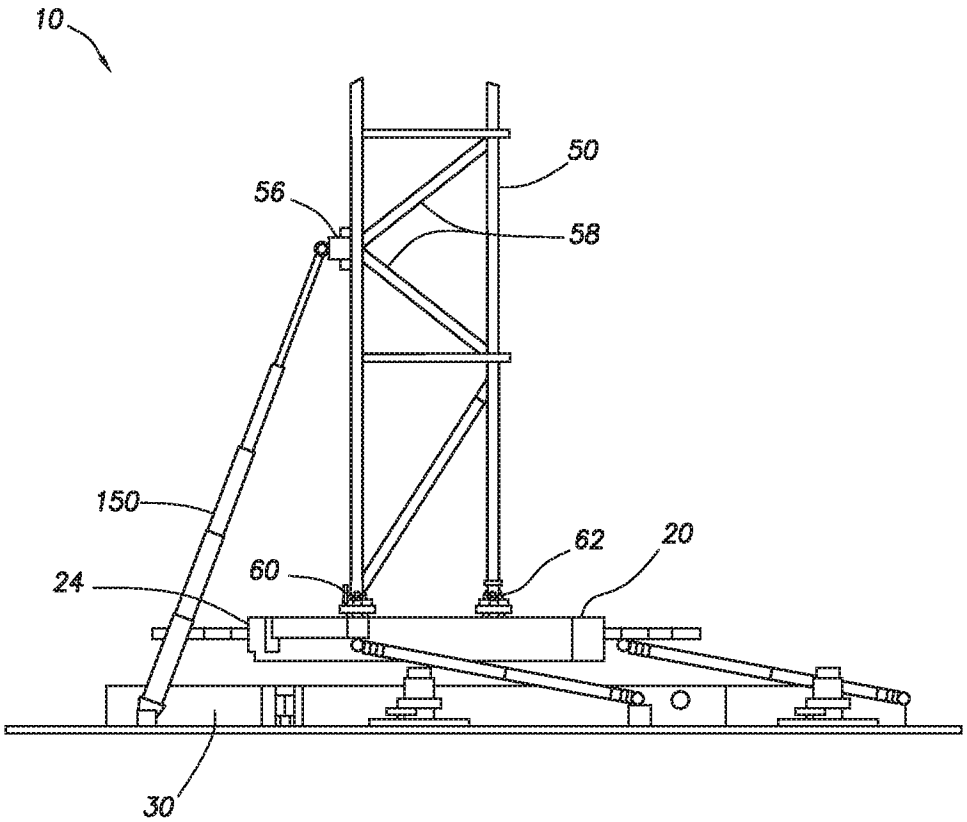
FIG. 3 depicts a side view of the side saddle slingshot rig of FIG. 2 in a mast-raised position.
Figure 4:
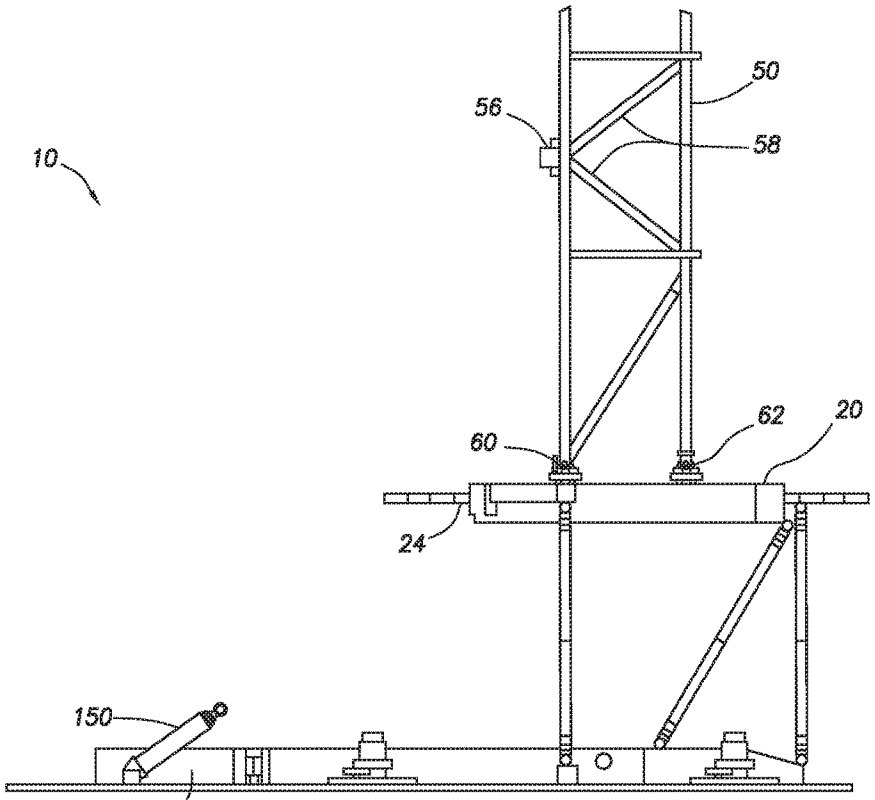
FIG. 4 depicts a side view of the side saddle slingshot rig of FIG. 2 in a raised position.
Figure 5:
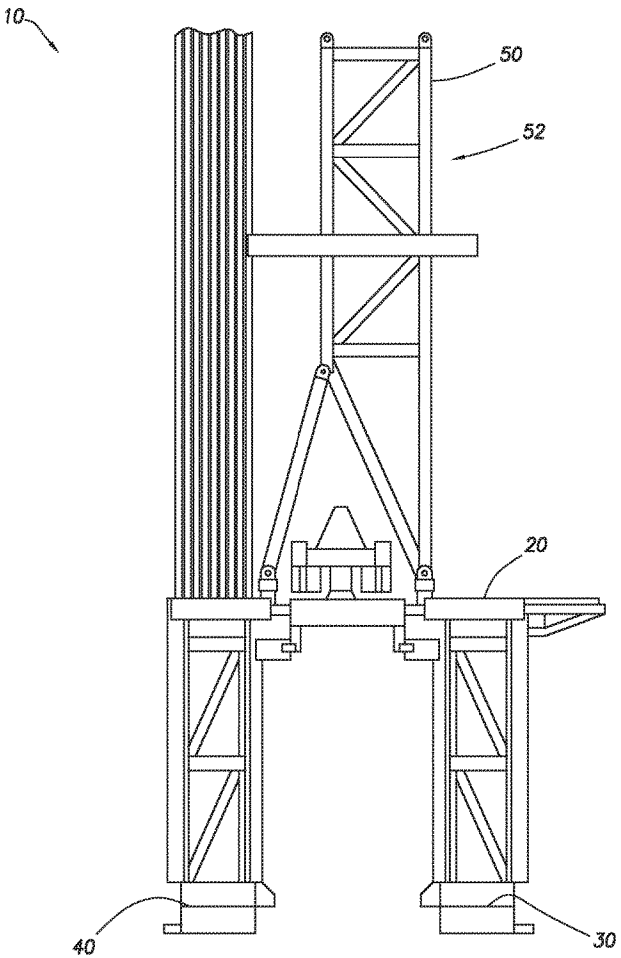
FIG. 5 depicts a side view of the side saddle slingshot rig of FIG. 2 in a raised position perpendicular to the view of FIG. 4.

In some embodiments, to move mast 50 from the lowered position to the mast raised position, mast 50 may be mechanically and pivotably coupled to drill rig floor 20 by one or more pivot points 60. One or more hydraulic cylinders 150 may be mechanically coupled to mast 50. In some embodiments, hydraulic cylinders 150 may mechanically couple to one or more corresponding upper mast attachment points 56 positioned on mast 50. In some embodiments, mast 50 may include one or more braces 58 positioned to, for example and without limitation, brace mast 50 at upper mast attachment points 56. In some embodiments, mast 50 may be moved into the mast raised position by extending hydraulic cylinders 150 such that mast 50 moves from a horizontal position to a vertical position as depicted in FIG. 3. Mast 50 may be mechanically coupled to drill rig floor 20 by one or more lower mast attachment points 62. In some embodiments, hydraulic cylinders 150 may be detached from upper mast attachment points 56 and mechanically coupled to drill rig floor lifting points 24. Hydraulic cylinders 150 may then be extended to move drill rig floor 20 from the lowered position as depicted in FIG. 3 to the raised position as depicted in FIGS. 4, 5. Hydraulic cylinders 150 may be disconnected from drill rig floor lifting points 24, retracted and stored in right and left substructures 30, 40. In some embodiments, hydraulic cylinders 150 may be utilized to transition side saddle slingshot drilling rig 10 from the raised position to the mast raised position and the lowered position by reversing the previously described operations.

Figure 6:
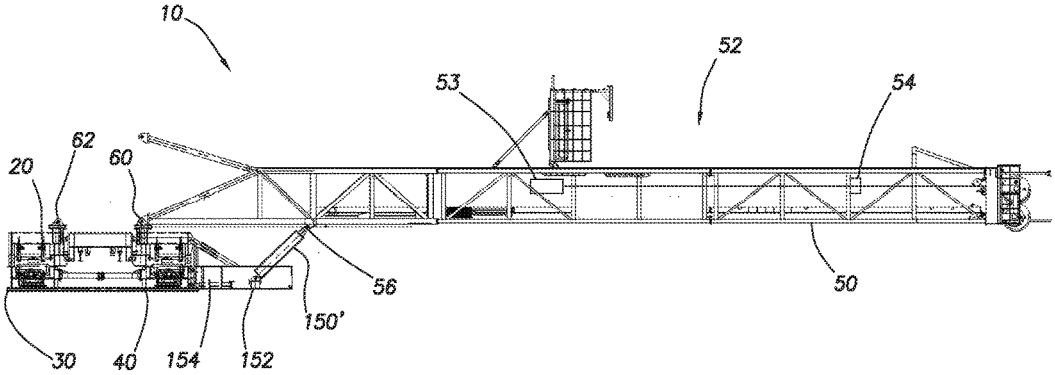
FIG. 6 depicts a side view of a side saddle slingshot rig consistent with at least one embodiment of the present disclosure in a lowered position.
Figure 7:
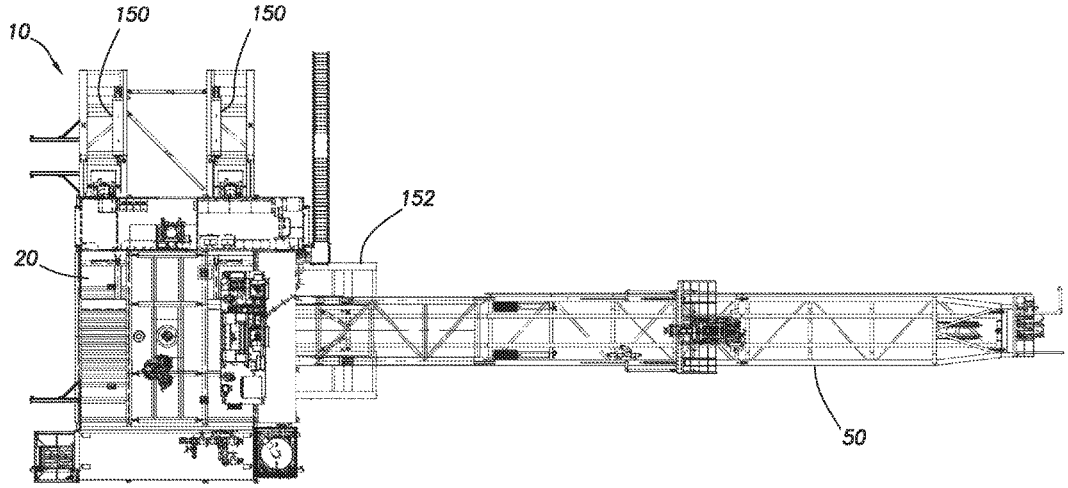
FIG. 7 depicts a top view of the side saddle slingshot rig of FIG. 6.

In some embodiments, as depicted in FIGS. 6, 7, mast 50 may be lowerable in a direction perpendicular to and away from V-door side 22 of side saddle slingshot drilling rig 10. In such an embodiment, mast V-door side 52 may be oriented to face vertically upward or vertically downward when mast 50 is in the lowered position. In such an embodiment, components of mast 50 including, for example and without limitation, top drive 53 and traveling block 54 may be retained within mast 50 without additional components. In some embodiments, mast 50 may be removable from drill rig floor 20 by disconnecting mast 50 from drill rig floor 20 at pivot points 60. In some such embodiments, mast 50 may be transported horizontally.

As shown in FIG. 6, in some embodiments, to move mast 50 from the lowered position to the mast raised position, one or more mast hydraulic cylinders 150' may be mechanically coupled to mast 50. In some embodiments, hydraulic cylinders 150 may mechanically couple to one or more corresponding upper mast attachment points 56 positioned on mast 50. In some embodiments, mast hydraulic cylinders 150' may be positioned on cylinder sub box 152. In some embodiments, cylinder sub box 152 may be coupled to left substructure 40 before mast 50 is coupled to drill rig floor 20. In some embodiments, cylinder sub box 152 may include ballast weight 154 to, for example and without limitation, restrict cylinder sub box 152 from overturning. In some embodiments, mast hydraulic cylinders 150' may be mechanically coupled to upper mast attachment points 56 positioned on mast 50. In some embodiments, mast 50 may be moved into the mast raised position by extending mast hydraulic cylinders 150' such that mast 50 moves from a horizontal position to a vertical position. Mast 50 may be mechanically coupled to drill rig floor 20 by one or more lower mast attachment points 62 as previously described. In some embodiments, mast hydraulic cylinders 150' may be detached from upper mast attachment points 56. Hydraulic cylinders 150 may then be utilized to raise drill rig floor 20 as previously described.

Figure 8:
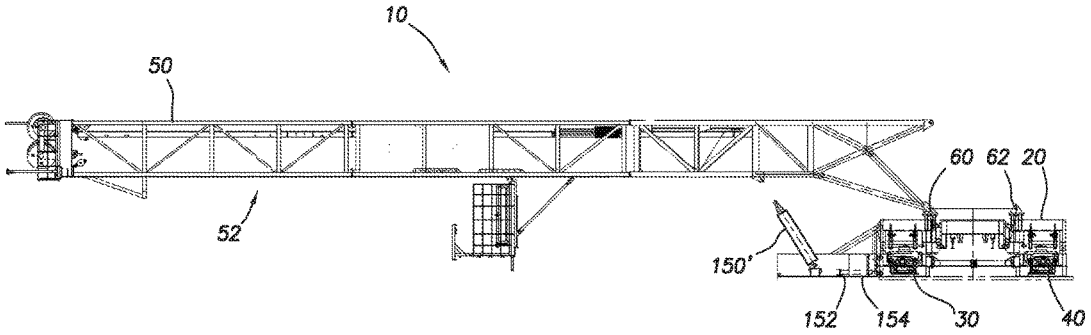
FIG. 8 depicts a side view of a side saddle slingshot rig consistent with at least one embodiment of the present disclosure.
Figure 9:
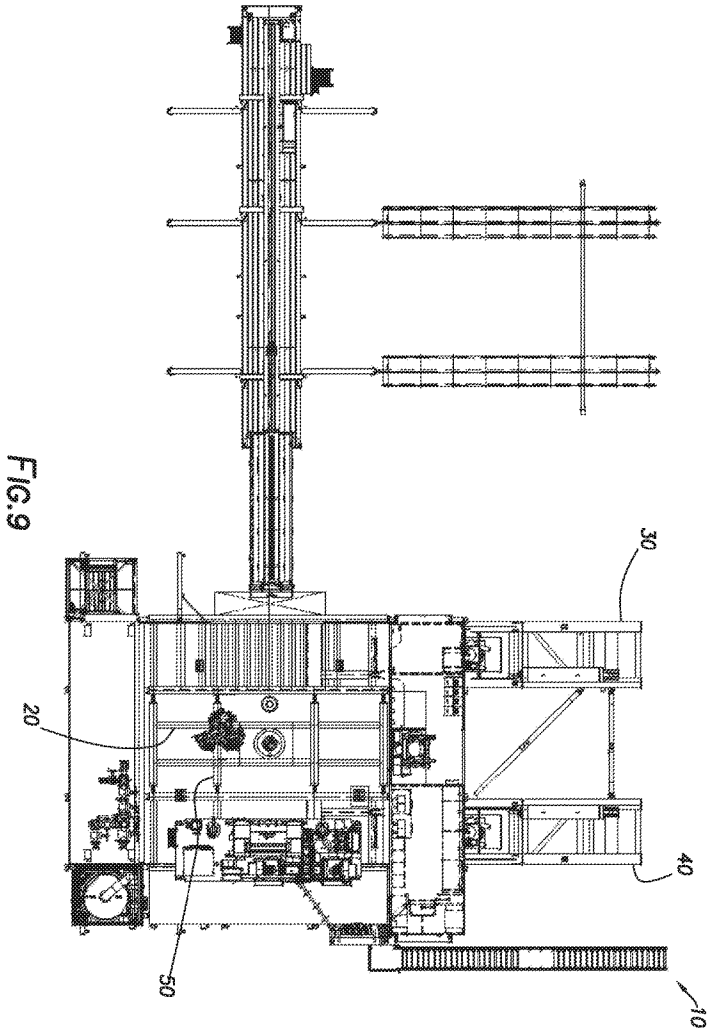
FIG. 9 depicts a top view of the side saddle slingshot rig of FIG. 8 in the raised position.

In some embodiments, as depicted in FIGS. 8, 9, mast 50 may be lowerable in a direction perpendicular to and toward V-door side 22 of side saddle slingshot drilling rig 10. In such an embodiment, mast V-door side 52 may be oriented to face vertically downward when mast 50 is in the lowered position. In some embodiments, mast 50 may be removable from drill rig floor 20 by disconnecting mast 50 from drill rig floor 20 at pivot points 60. In some such embodiments, mast 50 may be transported horizontally.

In some embodiments, to move mast 50 from the lowered position to the mast raised position, one or more mast hydraulic cylinders 150' may be coupled to mast 50. In some embodiments, mast hydraulic cylinders 150' may be positioned on cylinder sub box 152. In some embodiments, cylinder sub box 152 may be mechanically coupled to right substructure 30. In some embodiments, cylinder sub box 152 may include ballast weight 154 to, for example and without limitation, restrict cylinder sub box 152 from overturning. In some embodiments, mast hydraulic cylinders 150' may be mechanically coupled to upper mast attachment points 56 positioned on mast 50. In some embodiments, mast 50 may be moved into the mast raised position as depicted in FIG. 9 by extending mast hydraulic cylinders 150' such that mast 50 moves from a horizontal position to a vertical position. Mast 50 may be mechanically coupled to drill rig floor 20 by one or more lower mast attachment points 62 as previously described. In some embodiments, mast hydraulic cylinders 150' may be detached from upper mast attachment points 56. Hydraulic cylinders 150 may then be utilized to raise drill rig floor 20 as previously described.

Figure 10:
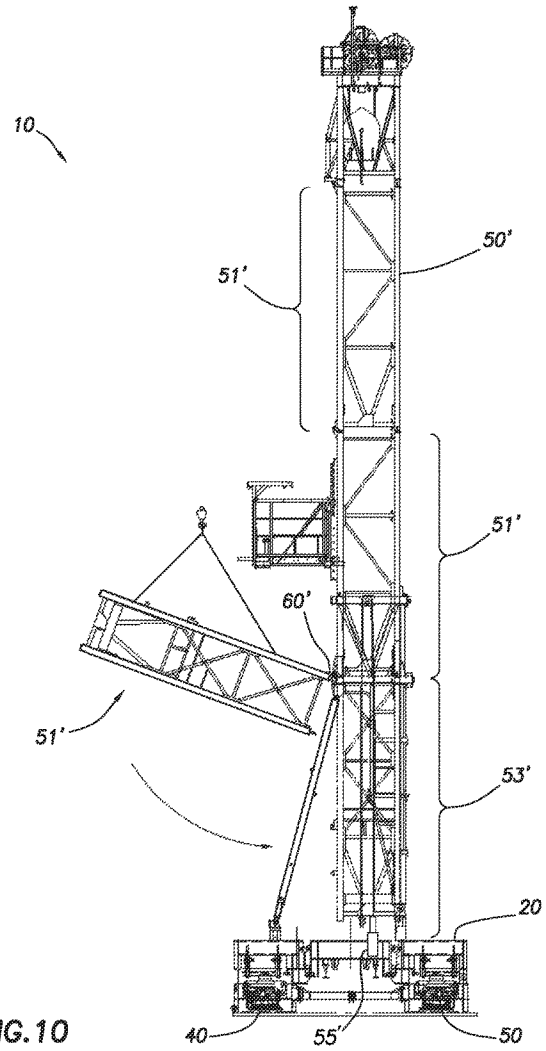
FIG. 10 depicts a side view of a side saddle bootstrap rig consistent with at least one embodiment of the present disclosure.

In some embodiments, mast 50' as depicted in FIG. 10 may be a bootstrap style mast. In such an embodiment, mast 50' may include one or more mast subcomponents 51'. Each mast subcomponent 51' may include an open side defining mast V-door side 52 of mast 50'. In some embodiments, mast V-door side 52 may be oriented to face perpendicular to right substructure 30. Mast subcomponents 51' may be sequentially hoisted onto drill rig floor 20. In some embodiments, mast subcomponents 51' may be placed within mast lower subcomponent 53' and may be hoisted vertically upward within mast lower subcomponent 53'. In some embodiments, a subsequent mast subcomponent 51' may be inserted within mast lower subcomponent 53' through mast V-door side 52 of mast lower subcomponent 53', mechanically coupled to the previously hoisted mast subcomponent or subcomponents 51', and hoisted. In some embodiments, a drawworks may be utilized to hoist the mast subcomponents 51'. In some embodiments, one or more hydraulic cylinders 55' may be utilized to hoist the mast subcomponents 51'. In certain embodiments, once mast 50' is a desired height, the mechanically coupled mast subcomponents 51' may be mechanically coupled to mast lower subcomponent 53'. Mast lower subcomponent 53' may be mechanically coupled to drill rig floor 20. Mast subcomponents 51' may be mechanically coupled at pivot point 60' to, for example and without limitation, allow the mast subcomponents 51' to pivot into mast lower subcomponent 53'.

Figure 11:
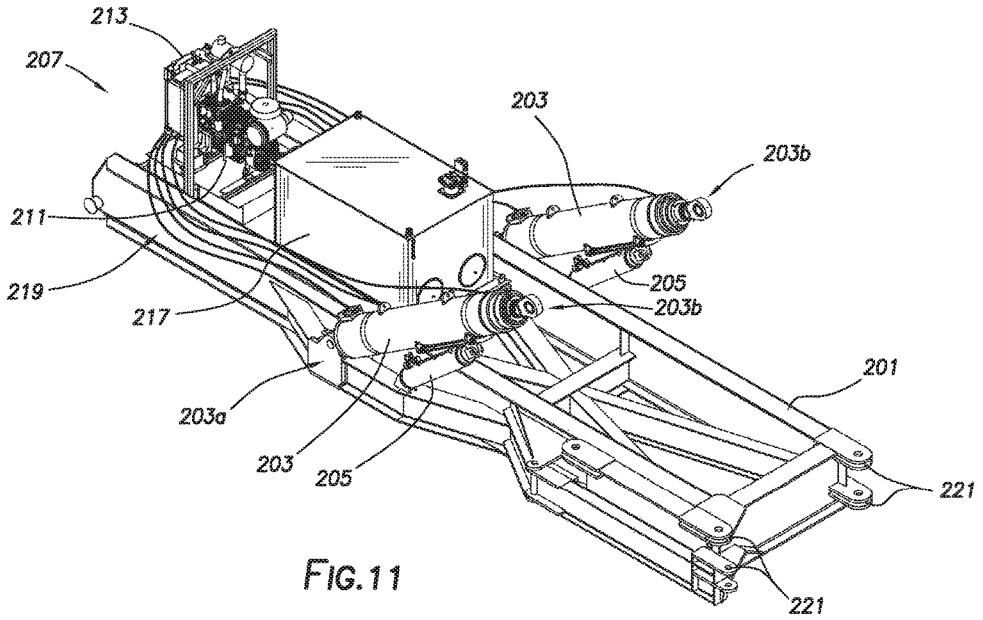
FIG. 11 depicts a hydraulic cylinder skid consistent with at least one embodiment of the present disclosure.
Figure 12:
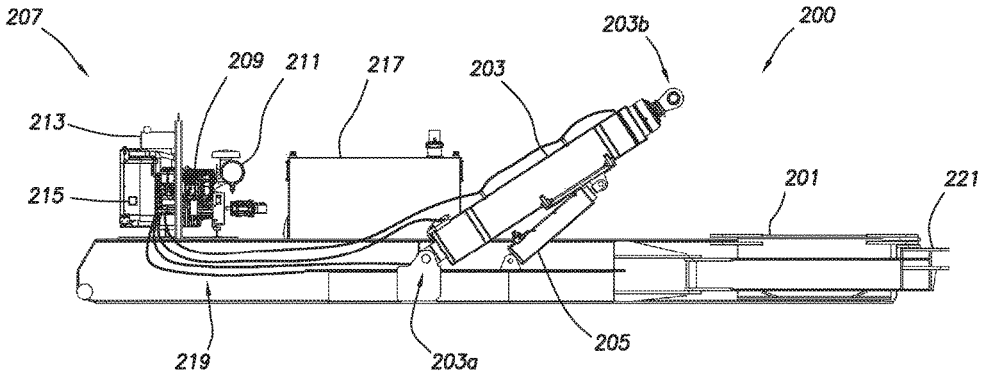
FIG. 12 is a side view of the hydraulic cylinder skid of FIG. 11.

FIGS. 11 and 12 depict hydraulic cylinder skid 200. Hydraulic cylinder skid 200 may include skid frame 201. Skid frame 201 may support other components of hydraulic cylinder skid 200 and allow for transportation of hydraulic cylinder skid 200 as a single unit. In some embodiments, hydraulic cylinder skid 200 may include one or more raising cylinders 203. Raising cylinders 203 may be pivotably coupled to skid frame 201 at lower end 203*a* of raising cylinders 203. In some embodiments, hydraulic cylinder skid 200 may include cylinder positioning hydraulic cylinders 205. Each cylinder positioning hydraulic cylinder 205 may mechanically couple between skid frame 201 and a respective raising cylinder 203. Extension or retraction of cylinder positioning hydraulic cylinders 205 may allow the angle at which raising cylinders 203 extend from hydraulic cylinder skid 200 to be controlled. By modulating the extension of raising cylinders 203 and cylinder positioning hydraulic cylinders 205, upper end 203*b* of raising cylinders 203 may be positioned in space to, for example and without limitation, align with drill rig floor lifting points 24, upper mast attachment points 56 or any other desired position as described further herein below.

In some embodiments, hydraulic cylinder skid 200 may include hydraulic power unit 207. Hydraulic power unit 207 may be mechanically coupled to skid frame 201. Hydraulic power unit 207 may generate hydraulic pressure that may be used, for example and without limitation, to extend or retract raising cylinders 203 and cylinder positioning hydraulic cylinders 205. In some embodiments, hydraulic power unit 207 may include hydraulic pump 209. Hydraulic pump 209 may be used to pressurize hydraulic fluid. In some embodiments, hydraulic pump 209 may be powered mechanically by pump engine 211. Pump engine 211 may be, for example and without limitation, a combustion engine or electric motor.

In some embodiments, hydraulic power unit 207 may operatively couple to raising cylinders 203 and cylinder positioning hydraulic cylinders 205 through hydraulic cylinder skid controls 213. Hydraulic cylinder skid controls 213 may include one or more manifolds and valves positioned to control the flow of hydraulic fluid to raising cylinders 203 and cylinder positioning hydraulic cylinders 205 in order to control the extension or retraction of raising cylinders 203 and cylinder positioning hydraulic cylinders 205. In some embodiments, hydraulic cylinder skid controls 213 may be manually operated. In some embodiments, hydraulic cylinder skid controls 213 may be at least partially automated. In such an embodiment, hydraulic cylinder skid controls 213 may include programmable logic controller (PLC) 215 adapted to control the operation of raising cylinders 203 and cylinder positioning hydraulic cylinders 205.

In some embodiments, hydraulic cylinder skid 200 may include other components of a hydraulic system including, for example and without limitation, hydraulic reservoir 217 and hydraulic lines 219. In some embodiments, by including all components of a hydraulic system, hydraulic cylinder skid 200 may be transportable and usable without the need to disassemble or reassembly components of hydraulic cylinder skid 200.

In some embodiments, skid frame 201 may include rig attachment points 221. Rig attachment points 221 may be adapted to allow skid frame 201 to be mechanically coupled to a drilling rig in order to use raising cylinders 203 to interact with components of the drilling rig as discussed further below. Rig attachment points 221 may include, for example and without limitation, one or more holes that correspond to holes formed on the drilling rig to allow a pin-connection to be made to temporarily mechanically couple hydraulic cylinder skid 200 to the drilling rig.

Figure 13:
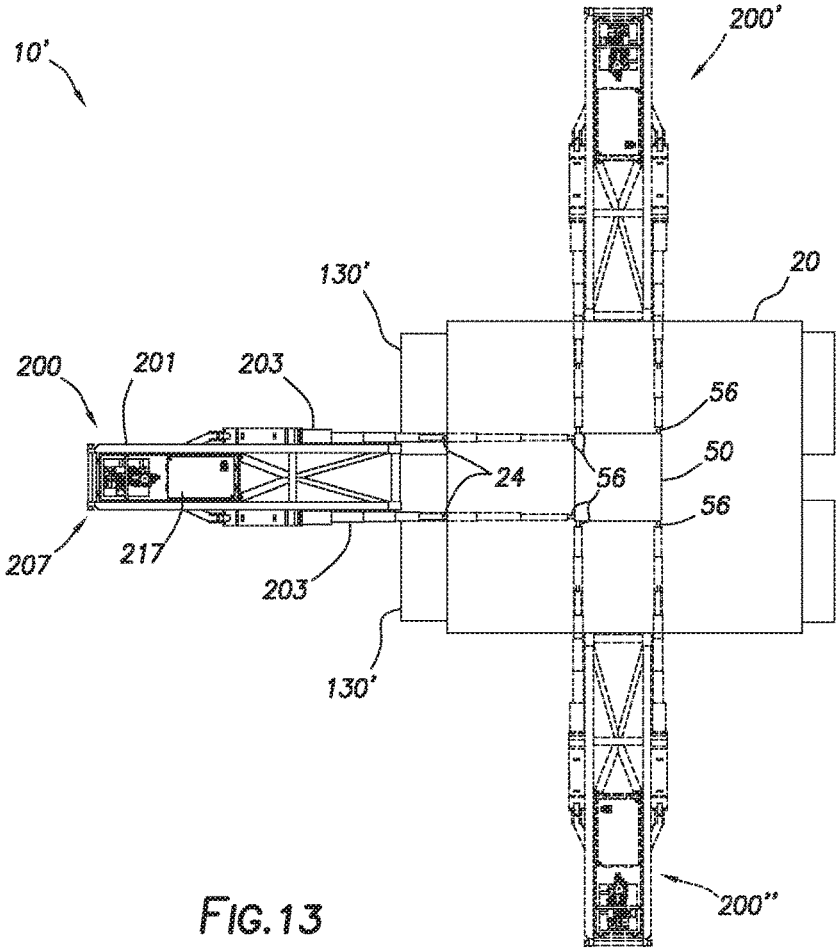
FIG. 13 depicts a top view of the side saddle slingshot rig with an attached hydraulic cylinder skid consistent with at least one embodiment of the present disclosure.

For example, FIG. 13 depicts hydraulic cylinder skid 200 mechanically coupled to side saddle slingshot drilling rig 10'. In some embodiments, hydraulic cylinder skid 200 may be mechanically coupled to side saddle slingshot drilling rig 10' at an end of lower boxes 130' corresponding with the direction in which drill rig floor 20 moves when moved to the lowered position as discussed herein above. In some embodiments rig attachment points 221 may mechanically couple to corresponding attachment points formed on one or both of lower boxes 130'. In some embodiments, hydraulic cylinder skid 200 may be used to move drill rig floor 20 between the raised and the lowered position using raising cylinders 203 substantially as described with respect to hydraulic cylinders 150 as described herein above. For example, in some embodiments, upper end 203*b* of raising cylinders 203 may mechanically couple to one or more corresponding drill rig floor lifting points 24 of drill rig floor 20. Raising cylinders 203 may then be extended to move drill rig floor 20 from the lowered position to the raised position, or may be retracted to move drill rig floor 20 from the raised position to the lowered position. Once drill rig floor is in the desired position, raising cylinders 203 may be decoupled from drill rig floor lifting points 24.

In some embodiments in which mast 50 is lowerable in a direction parallel to V-door side 22 of side saddle slingshot drilling rig 10', hydraulic cylinder skid 200 may be used to move mast 50 between the raised and lowered positions while mechanically coupled to side saddle slingshot drilling rig 10' at an end of lower boxes 130'. In such an embodiment, upper end 203*b* of raising cylinders 203 may mechanically couple to one or more corresponding upper mast attachment points 56 of mast 50. Raising cylinders 203 may then be extended to move mast 50 from the lowered position to the raised position, or may be retracted to move mast 50 from the raised position to the lowered position. Once mast 50 is in the desired position, raising cylinders 203 may be decoupled from upper mast attachment points 56.

In embodiments in which mast 50 is lowerable in a direction perpendicular to V-door side 22 of side saddle slingshot drilling rig 10', hydraulic cylinder skid 200 may be used to raise drill rig floor 20 as described above mechanically coupled to side saddle slingshot drilling rig 10' at an end of lower boxes 130'. In order to raise mast 50 from the lowered position to the raised position, hydraulic cylinder skid 200 may be mechanically coupled to side saddle slingshot drilling rig 10' at a side of one of lower boxes 130' depending on the direction in which mast 50 is lowered, denoted in FIG. 13 as hydraulic cylinder skid 200' and 200". In such an embodiment, with hydraulic cylinder skid 200' or 200" mechanically coupled to the side of one of lower boxes 130', In such an embodiment, upper end 203*b* of raising cylinders 203 may mechanically couple to one or more corresponding upper mast attachment points 56 of mast 50. Raising cylinders 203 may then be extended to move mast 50 from the lowered position to the raised position, or may be retracted to move mast 50 from the raised position to the lowered position. Once mast 50 is in the desired position, raising cylinders 203 may be decoupled from upper mast attachment points 56, and hydraulic cylinder skid 200' or 200" may be mechanically decoupled from the respective lower box 130', moved to the position at the end of lower boxes 130' denoted hydraulic cylinder skid 200, and may be used to raise or lower drill rig floor 20 as discussed above.

One having ordinary skill in the art with the benefit of this disclosure will understand that the present disclosure does not limit the order of raising or lowering of mast 50 and drill rig floor 20.

Once drill rig floor 20 and mast 50 are in the desired raised or lowered positions, upper end 203*b* of raising cylinders 203 may be mechanically decoupled from drill rig floor lifting points 24 and upper mast attachment points 56, raising cylinders 203 may be fully retracted for storage, and hydraulic cylinder skid 200 may be mechanically decoupled from side saddle slingshot drilling rig 10'. During operation or transportation of side saddle slingshot drilling rig 10', hydraulic cylinder skid 200 needs not remain mechanically coupled to side saddle slingshot drilling rig 10'. In some embodiments, hydraulic cylinder skid 200 may be removed from side saddle slingshot drilling rig 10' to, for example and without limitation, reduce the weight of, footprint of, and number of components carried by side saddle slingshot drilling rig 10' during operation or transportation of side saddle slingshot drilling rig 10'. In some embodiments, hydraulic cylinder skid 200 may be transported to a second drilling rig on the same or another wellsite to raise or lower the respective drill floor or mast of the second drilling rig.

In some embodiments, because hydraulic cylinder skid 200 includes raising cylinders 203, cylinder positioning hydraulic cylinders 205, hydraulic power unit 207, hydraulic pump 209, pump engine 211, hydraulic cylinder skid controls 213, hydraulic reservoir 217, and hydraulic lines 219 all mechanically coupled to skid frame 201, hydraulic cylinder skid 200 may be transported as a single unit without the need to disconnect any operative couplings between the components of hydraulic cylinder skid 200. In some embodiments, such as where pump engine 211 is a combustion engine, hydraulic cylinder skid 200 may operate independently without any additional connections to external equipment required.

Although described with respect to side saddle slingshot drilling rig 10' as described herein, one having ordinary skill in the art with the benefit of this disclosure will understand that hydraulic cylinder skid 200 may be used with any drilling rig with a pivoting drilling floor, pivoting mast, or both Certain embodiments of the disclosure are directed to a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The drilling rig may include a mast. The mast may be pivotably coupled to the drill rig floor by one or more pivot points and one or more mast attachment points. The mast may include an open side defining a mast V-door side. The open side may be oriented to face perpendicular to the right substructure.

Certain embodiments of the disclosure are directed to a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The drilling rig may include a mast. The mast may include one or more mast subcomponents. The mast subcomponents may be mechanically coupled together and to the drill rig floor. The mast may include an open side defining a mast V-door side. The open side may be oriented to face perpendicular to the right substructure.

Certain embodiments of the disclosure are directed to a method. The method may include providing a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The drill rig floor may include one or more pivot points. The method may include providing a mast. The mast may include an open side defining a mast V-door side. The open side may be oriented to face perpendicular to the right substructure. The method may include mechanically coupling the mast to the one or more pivot points, mechanically coupling one or more hydraulic cylinders to the mast, and raising the mast into a raised position.

Certain embodiments of the disclosure are directed to a method. The method may include providing a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The method may include providing a lower mast subcomponent. The lower mast subcomponent may include an open side defining a V-door side of the lower mast subcomponent. The V-door side of the lower mast subcomponent may be oriented to face perpendicular to the right substructure. The method may further comprise mechanically coupling the lower mast subcomponent to the drill rig floor. The method may further comprise providing a mast subcomponent, positioning the mast subcomponent within the lower mast subcomponent, hoisting the mast subcomponent, and mechanically coupling the mast subcomponent to the lower mast subcomponent.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A drilling rig comprising:

a right substructure and a left substructure, the substructures positioned generally parallel and spaced apart from each other;

the right substructure comprises a right lower box and a first strut, the first strut pivotably coupled to a drill rig floor and pivotably coupled to the right lower box, the drill rig floor including a V-door, the side of the drill rig floor including the V-door defining the V-door side of the drill rig floor, the V-door oriented to face perpendicular to the right substructure;

the left substructure comprises a left lower box and a second strut, the second strut pivotably coupled to the drill rig floor and pivotably coupled to the left lower box;

a cylinder sub box, the cylinder sub box including one or more mast hydraulic cylinders, the cylinder sub box coupled to the left substructure at a side of the left substructure or to the right substructure at a side of the right substructure; and a mast, the mast including an open side defining a mast V-door side, the open side oriented to face perpendicular to the right substructure, the mast pivotably coupled to the drill rig floor by one or more pivot points and one or more lower mast attachment points, the mast being pivotable in a direction perpendicular to the V-door side of the drill rig floor.

2. The drilling rig of claim 1, wherein the struts form a bar linkage between the lower boxes and the drill rig floor.

3. The drilling rig of claim 2, wherein the struts are adapted to allow motion of the drill rig floor relative to the lower boxes while maintaining the drill rig floor parallel to the lower boxes.

4. The drilling rig of claim 1, wherein the V-door side of the drilling rig floor is parallel to the right substructure.

5. The drilling rig of claim 1, wherein the right and left lower boxes further comprise one or more hydraulic cylinders, the hydraulic cylinders mechanically coupled to one or more corresponding drill rig floor lifting points.

6. The drilling rig of claim 5, wherein the mast includes one or more braces positioned to brace the mast at the mast attachment points of the mast.

7. The drilling rig of claim 1, wherein the mast hydraulic cylinders are mechanically coupled to one or more corresponding upper mast attachment points of the mast.

8. The drilling rig of claim 7, wherein the mast is pivotable in a direction away from the V-door side of the drill rig floor when lowered, and wherein the cylinder sub box is mechanically coupled to the left lower box.

9. The drilling rig of claim 7, wherein the mast is pivotable in a direction toward the V-door side of the drill rig floor when lowered, and wherein the cylinder sub box is mechanically coupled to the right lower box.

10. The drilling rig of claim 1, wherein the mast comprises one or more mast subcomponents, the mast subcomponents mechanically coupled together and to the drill rig floor.

11. The drilling rig of claim 10, wherein the mast comprises a lower mast subcomponent, the lower mast subcomponent mechanically coupled to the drill rig floor.

12. The drilling rig of claim 1, wherein the mast V-door side is oriented to face vertically upward when the mast is in a lowered position.

13. A drilling rig comprising:

a right substructure and a left substructure, the substructures positioned generally parallel and spaced apart from each other;

the right substructure comprises a right lower box and a first strut, the first strut pivotably coupled to a drill rig floor and pivotably coupled to the right lower box, the drill rig floor including a V-door, the side of the drill rig floor including the V-door defining the V-door side of the drill rig floor, the V-door oriented to face perpendicular to the right substructure;

the left substructure comprises a left lower box and a second strut, the second strut pivotably coupled to the drill rig floor and pivotably coupled to the left lower box;

a cylinder sub box, the cylinder sub box including one or more mast hydraulic cylinders, the cylinder sub box coupled to the left substructure at a side of the left substructure or to the right substructure at a side of the right substructure; and a mast, the mast including an open side defining a mast V-door side, the open side oriented to face perpendicular to the right substructure, the mast pivotably coupled to the drill rig floor by one or more pivot points and one or more lower mast attachment points, the mast being pivotable in a direction parallel to the V-door side of the drill rig floor such that the open side of the mast is oriented to face horizontally when the mast is in a lowered position.

14. The drilling rig of claim 13, wherein the struts form a bar linkage between the lower boxes and the drill rig floor.

15. The drilling rig of claim 14, wherein the struts are adapted to allow motion of the drill rig floor relative to the lower boxes while maintaining the drill rig floor parallel to the lower boxes.

16. The drilling rig of claim 13, wherein the V-door side of the drilling rig floor is parallel to the right substructure.

17. The drilling rig of claim 13, wherein the right and left lower boxes further comprise one or more hydraulic cylinders, the hydraulic cylinders mechanically coupled to one or more corresponding drill rig floor lifting points.

18. The drilling rig of claim 17, wherein the mast includes one or more braces positioned to brace the mast at the mast attachment points of the mast.

19. The drilling rig of claim 13, wherein the mast hydraulic cylinders are mechanically coupled to one or more corresponding upper mast attachment points of the mast.

20. The drill rig of claim 17, wherein the hydraulic cylinders are adapted to decouple from the drill rig floor lifting points.

21. The drilling rig of claim 13, wherein the mast comprises one or more mast subcomponents, the mast subcomponents mechanically coupled together and to the drill rig floor.

22. The drilling rig of claim 21, wherein the mast comprises a lower mast subcomponent, the lower mast subcomponent mechanically coupled to the drill rig floor.

* * * * *